US009173534B2

(12) United States Patent
Ando et al.

(10) Patent No.: US 9,173,534 B2
(45) Date of Patent: Nov. 3, 2015

(54) BRUSH AND ROTARY BRUSH UNIT FOR ELECTRIC VACUUM CLEANER

(71) Applicant: TSUCHIYA TSCO CO., LTD., Aichi-ken (JP)

(72) Inventors: Sadahiro Ando, Chiryu (JP); Toru Kuwahara, Chiryu (JP)

(73) Assignee: Tsuchiya Tsco Co., Ltd., Aichi-ken (JP)

( * ) Notice: Subject to any disclaimer, the term of this patent is extended or adjusted under 35 U.S.C. 154(b) by 80 days.

(21) Appl. No.: 14/137,508

(22) Filed: Dec. 20, 2013

(65) Prior Publication Data

US 2014/0173849 A1 Jun. 26, 2014

(30) Foreign Application Priority Data

Dec. 25, 2012 (JP) ..... 2012-281586

(51) Int. Cl.

| | |
|---|---|
| ***A46B 3/08*** | (2006.01) |
| ***A46B 3/16*** | (2006.01) |
| ***A47L 9/04*** | (2006.01) |
| ***A46B 7/10*** | (2006.01) |
| ***A46B 3/18*** | (2006.01) |
| *A46B 3/02* | (2006.01) |
| *A46B 13/00* | (2006.01) |

(52) U.S. Cl.

CPC ..... *A47L 9/0477* (2013.01); *A46B 3/08* (2013.01); *A46B 3/16* (2013.01); *A46B 3/18* (2013.01); *A46B 3/02* (2013.01); *A46B 7/10* (2013.01); *A46B 13/006* (2013.01)

(58) Field of Classification Search

USPC ..... 15/179, 182, 183, 191.1, 192, 193, 195, 15/197–200, 202, 383

See application file for complete search history.

(56) References Cited

U.S. PATENT DOCUMENTS

| | | | | | |
|---|---|---|---|---|---|
| 1,196,237 | A | * | 8/1916 | Holm | 15/183 |
| 1,451,350 | A | * | 4/1923 | Unger | 300/21 |
| 1,475,074 | A | * | 11/1923 | McLaughlin | 15/179 |
| 1,663,584 | A | * | 3/1928 | Cleaves | 15/181 |
| 1,860,572 | A | * | 5/1932 | Cleaves | 15/182 |
| 3,072,945 | A | * | 1/1963 | Peterson | 15/202 |
| 5,445,438 | A | * | 8/1995 | Drumm | 300/21 |

FOREIGN PATENT DOCUMENTS

| | | | |
|---|---|---|---|
| JP | 06-125811 | A | 5/1994 |
| JP | 2006-296496 | * | 11/2006 |

* cited by examiner

*Primary Examiner* — Mark Spisich

(74) *Attorney, Agent, or Firm* — Christensen Fonder P.A.

(57) ABSTRACT

A brush includes a bristle section and a base. The bristle section includes fiber bundles and binding fibers, which bind and couple the fiber bundles together. The base has a clamping part, which clamps part of the bristle section. The fiber bundles are arranged in a row in a direction perpendicular to a direction in which fibers of the fiber bundles extend. The binding fibers are sequentially adjacent in a direction in which the fibers of the fiber bundles extend. The clamping part clamps part of the bristle section to cover the binding fibers.

5 Claims, 4 Drawing Sheets

BRUSH AND ROTARY BRUSH UNIT FOR ELECTRIC VACUUM CLEANER

CROSS-REFERENCE TO RELATED APPLICATIONS

This application is based on and claims priority from Japanese Patent Application No. 2012-281586, filed on Dec. 25, 2012, the entire contents of which are incorporated herein by reference.

BACKGROUND OF THE INVENTION

The present invention relates to a brush and a rotary brush unit for an electric vacuum cleaner.

In general, electric vacuum cleaners include a main body and a suction device, which is connected to the main body via a hose. An intake port is provided on the bottom surface of the suction device. While the suction device is moved on a floor surface such as a carpet, a wooden floor, and a tatami mat, air is drawn in from the intake port so that dust is drawn by suction into the main body. A suction device has been proposed that has a rotary brush unit therein to improve dust collection performance on the floor surface such as a carpet from which dust is not easily drawn in by suction of the air.

The rotary brush unit includes a rotating body and brushes, which are attached to the rotating body. As such a rotary brush unit, for example, a brush assembly disclosed in Japanese Laid-Open Patent Publication No. 6-125811 has been proposed. The brush assembly (brush) disclosed in Japanese Laid-Open Patent Publication No. 6-125811 is manufactured by inserting a brush (bristle section), which is formed by sewing and connecting pile fibers, into a groove of a brush base (base), and then sewing the brush onto the brush base.

However, in the brush assembly of Japanese Laid-Open Patent Publication No. 6-125811, since the brush is formed of pile fibers, the relative position of the brush with respect to the brush base cannot be maintained in a stable manner when the brush is sewn to the brush base. Thus, the joint portion between the brush base and the brush made by sewing is likely to loosen, and may cause lack of joint strength between the brush base and the brush.

SUMMARY OF THE INVENTION

The present invention provides a brush and a rotary brush unit for an electric vacuum cleaner that allows a bristle section and a base to be firmly joined.

In accordance with one aspect of the present invention, a brush that includes a bristle section and a base is provided. The bristle section includes a plurality of fiber bundles and a plurality of binding fibers, which bind and couple the fiber bundles together. The base has a clamping part for clamping part of the bristle section. The fiber bundles are arranged in a row in a direction perpendicular to a direction in which fibers of the fiber bundles extend. The binding fibers are sequentially adjacent in a direction in which the fibers of the fiber bundles extend. The clamping part clamps part of the bristle section to cover the binding fibers.

In the above described brush, the clamping part is preferably sewn to part of the bristle section where the binding fibers are arranged.

In the above described brush, the fiber bundles are preferably impregnated with an adhesive synthetic resin material.

In the above described brush, part of the fiber bundles clamped by the clamping part is preferably impregnated with the synthetic resin material.

In accordance with another aspect of the present invention, the above described brush is preferably included in a rotary brush unit for an electric vacuum cleaner, and the rotary brush unit preferably includes a rotating body configured to be rotationally accommodated in a head for drawing in dust on a floor surface. The brush is attached to the rotating body such that the brush is rotated when the head is moved on the floor surface. The brush contacts the floor surface at the same time that the rotating body is rotated.

Other aspects and advantages of the invention will become apparent from the following description, taken in conjunction with the accompanying drawings, illustrating by way of example the principles of the invention.

DETAILED DESCRIPTION OF THE PREFERRED EMBODIMENTS

A rotary brush unit 22 for an electric vacuum cleaner according to one embodiment will now be described with reference to the drawings.

Figure 1:
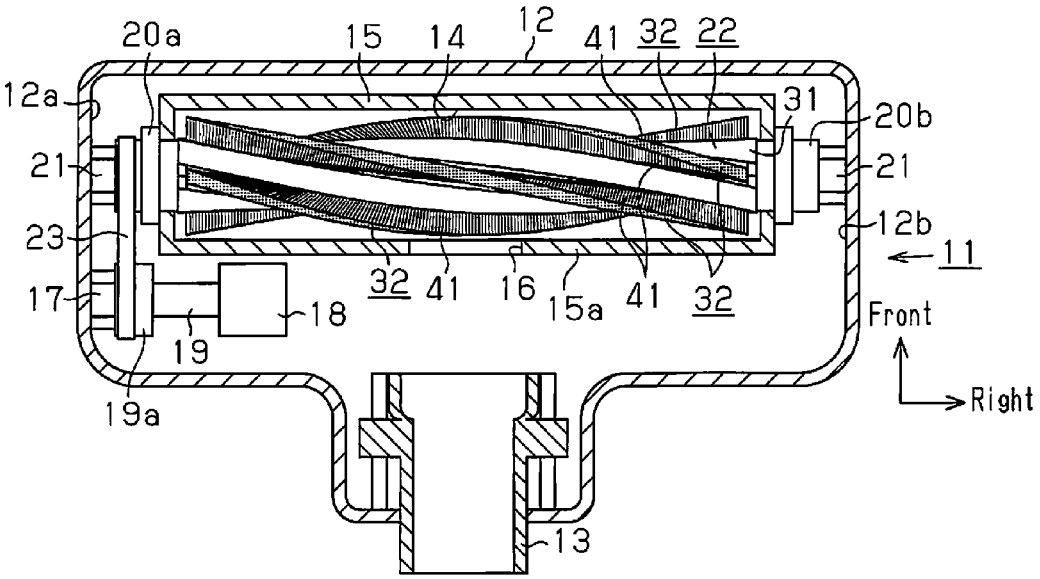
FIG. 1 is a cross-sectional plan view illustrating a head of an electric vacuum cleaner including a brush according to one embodiment of the present invention.
Figure 2:
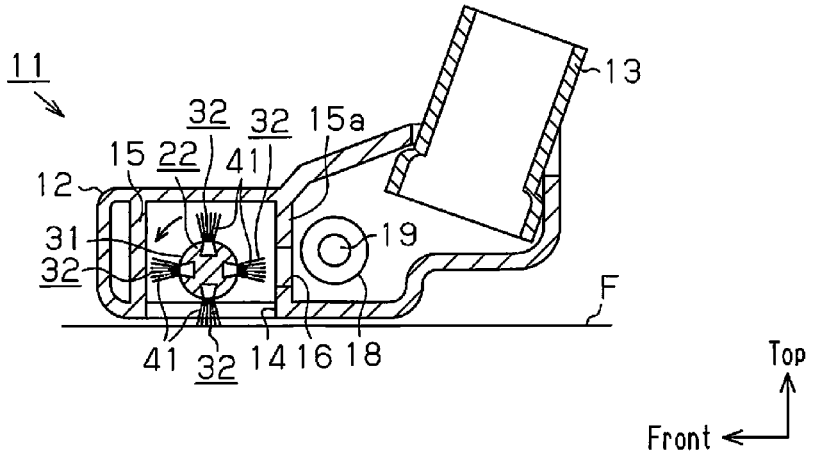
FIG. 2 is a lateral cross-sectional view illustrating the head of FIG. 1 in use.

FIGS. 1 and 2 show a head 11 of an electric vacuum cleaner for drawing in dust on a floor surface F. The head 11 includes a substantially T-shaped case 12 as seen in planar view. One end of a connecting pipe 13 is connected to the rear end of the case 12 to be rotational with respect to the case 12, and the other end of the connecting pipe 13 is connected to the main body (not shown) of the electric vacuum cleaner. A laterally extending rectangular intake port 14 is formed at the front end section of the bottom wall of the case 12. The intake port 14 extends through the bottom wall of the case 12.

A rectangular partition frame 15, which surrounds the intake port 14, is formed on the inner bottom surface of the case 12. An air suction port 16 is formed at the center of a rear wall 15*a*, which forms part of the partition frame 15, to extend through the rear wall 15*a*. A motor shaft bearing 17 is provided on a left inner surface 12*a* of the case 12. The motor shaft bearing 17 rotationally supports the distal end of a motor shaft 19, which extends from a motor 18. The motor 18 is arranged at the rear of the partition frame 15.

Rotational supports 20*a*, 20*b* are respectively provided on the left and right walls of the partition frame 15. The rotational supports 20*a*, 20*b* are rotationally supported by brush bearings 21 provided on the left inner surface 12*a* and a right inner surface 12*b* of the case 12. The rotary brush unit 22 is accommodated inside the partition frame 15 such that a rotation axis extends in the lateral direction. Opposite ends of the rotary brush unit 22 are supported by the rotational supports 20*a*, 20*b*.

An endless belt 23 is looped over the rotational support 20*a* on the left side and a roller 19*a* mounted on the motor shaft 19. Thus, when the motor 18 is driven, driving force of the motor 18 is transmitted to the rotary brush unit 22 via the motor shaft 19, the roller 19*a*, the belt 23, and the rotational support 20*a* on the left side.

The configuration of the rotary brush unit 22 will now be described in detail.

Figure 3:
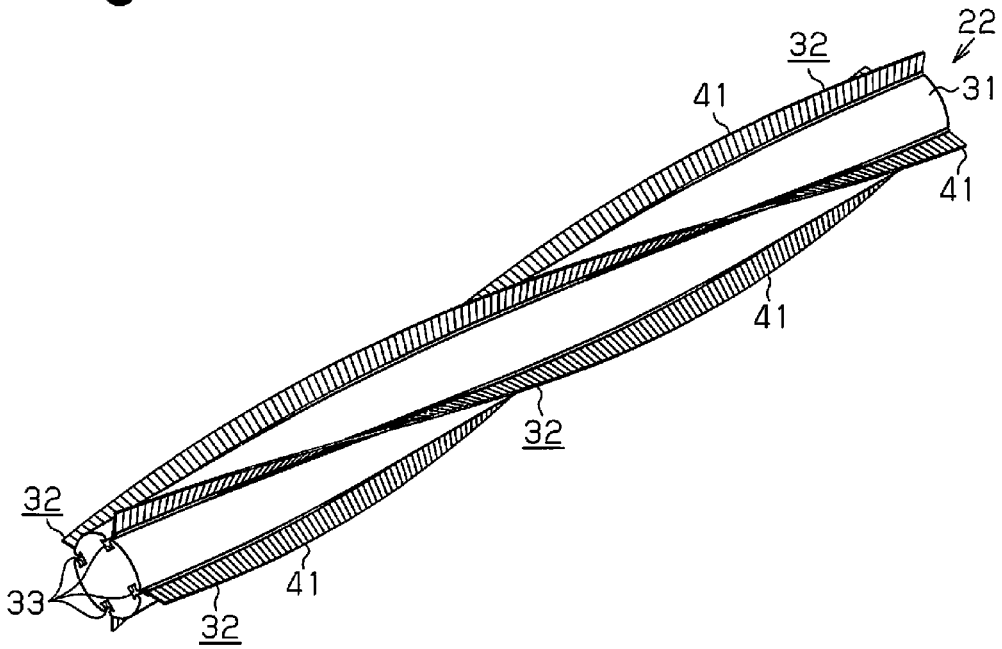
FIG. 3 is a perspective view illustrating the rotary brush unit according to one embodiment of the present invention.
Figure 4:
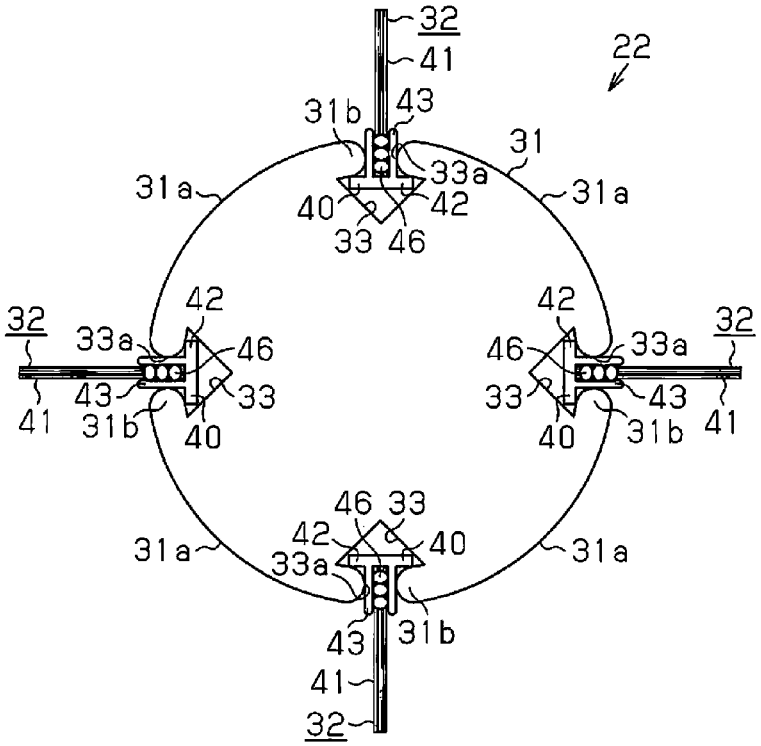
FIG. 4 is an enlarged side view illustrating the rotary brush unit of FIG. 3.

As shown in FIGS. 3 and 4, the rotary brush unit 22 includes a substantially round rod-like rotating body 31 and four brushes 32 attached to the rotating body 31. Four grooves 33, which extend from one end of the rotating body 31 to the other end, are formed on the outer circumferential surface of the rotating body 31 at equal intervals. The four grooves 33 are twisted at 180 degrees in a spiral form in the longitudinal direction of the rotating body 31. The four grooves 33 define substantially T-shaped four projections 31*a* on a cross section perpendicular to the longitudinal direction of the rotating body 31. The entire cross-section of the rotating body 31 is substantially X-shaped. Each brush 32 is mounted in one of the grooves 33. An opening 33*a* of each groove 33 is narrowed by flanges 31*b*, which bulge from the distal end of each projection 31*a* in the circumferential direction.

The configuration of the brushes 32 will now be described in detail.

Figure 5:
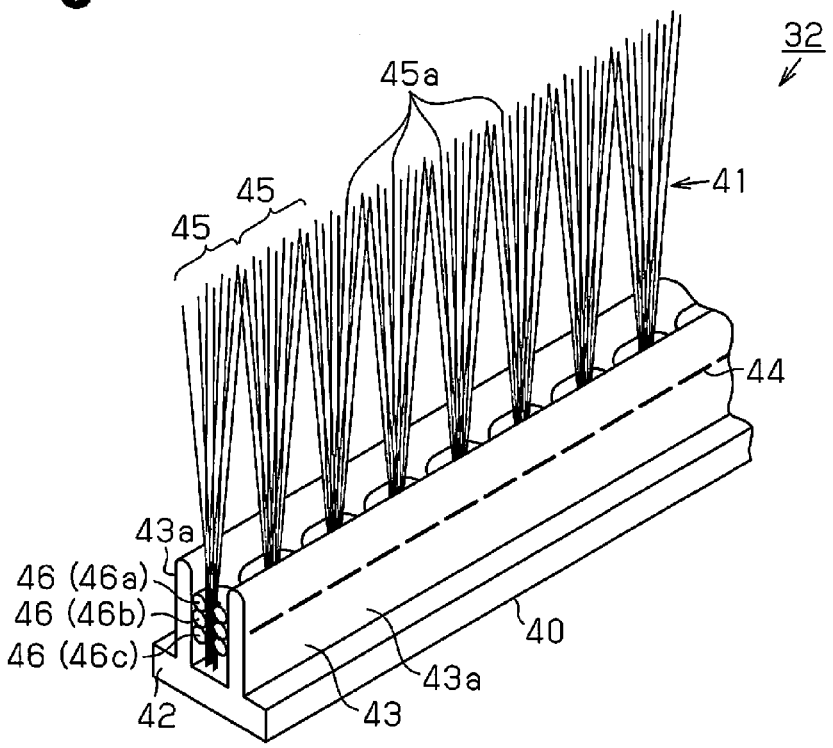
FIG. 5 is a schematic perspective view illustrating the brush used in the rotary brush unit of FIG. 3.

As shown in FIG. 5, each brush 32 includes an elongated base 40 and a row of bristles, that is, a bristle section 41 joined to the base 40. The base 40 is formed by extrusion molding of a thermoplastic synthetic plastic (in this embodiment, polyamide). The base 40 includes an elongated engaging portion 42, which is inserted in and engaged with the associated groove 33 (see FIG. 4) of the rotating body 31, and a clamping section 43, which is formed on the engaging portion 42. As shown in FIG. 4, the width of the engaging portion 42 is greater than the width of the opening 33*a* of the groove 33. The clamping section 43 clamps the proximal end of the bristle section 41.

The clamping section 43 is configured by a pair of ribbon-like clamping pieces 43*a*, which are arranged on the engaging portion 42 to face each other in the widthwise direction of the engaging portion 42. In a state in which the proximal end of the bristle section 41 is clamped by the clamping section 43, the clamping section 43 is sewn to the bristle section 41 by a sewing thread 44.

When attaching each brush 32 to the rotating body 31, the engaging portion 42 of the base 40 is slid into the corresponding groove 33 from an end of the rotating body 31 such that the bristle section 41 projects outward from the opening 33*a* of the groove 33. Since the base 40 has an adequate rigidity and elasticity, the base 40 (brush 32) can be twisted along each groove 33 in a spiral form. Thus, the brushes 32 are easily mounted on the rotating body 31.

Figure 6:
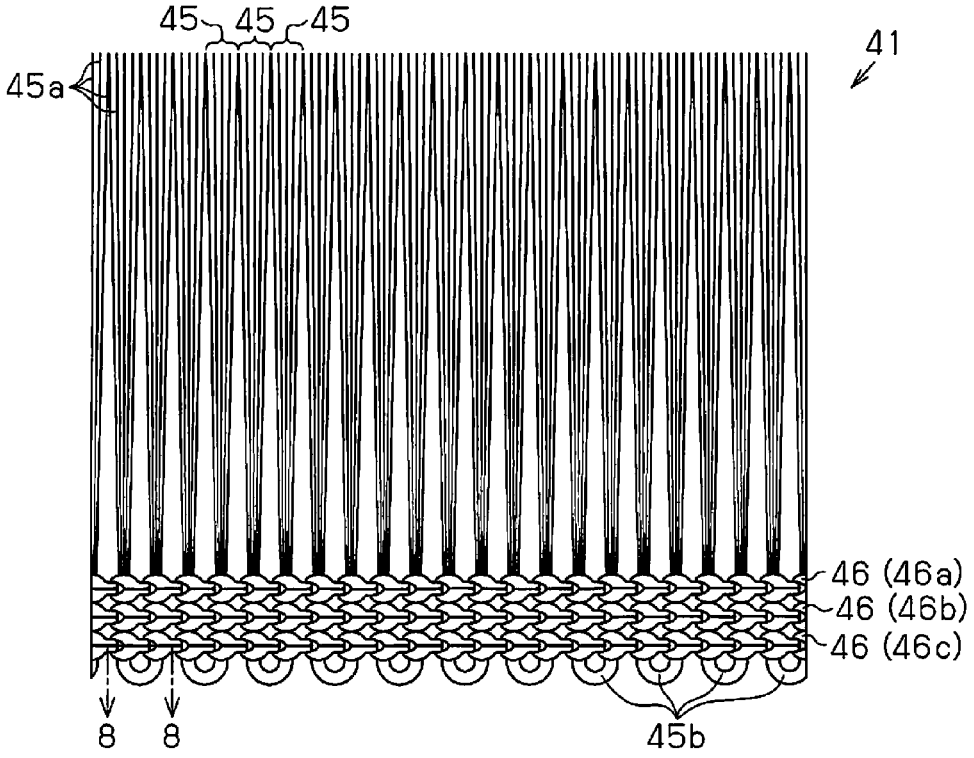
FIG. 6 is a plan view illustrating the bristle section of the brush of FIG. 5.

As shown in FIG. 6, the bristle section 41 includes fiber bundles 45, which are bundles of ultrafine monofilaments 45*a*, and binding fibers 46, which bind and couple the fiber bundles 45 together. The fiber bundles 45 are arranged in a row in a direction perpendicular to the direction in which the monofilaments 45*a* extend.

The examples of the monofilaments 45*a* include a polyamide fiber, a carbon fiber, a metal fiber such as a stainless-steel fiber, a rayon fiber, a cupro fiber, an acrylic fiber, a polypropylene fiber, and a polyester fiber. The monofilaments 45*a* of the present embodiment are made of a polyamide fiber.

The binding fibers 46 may be configured by binding fibers that are wound about multiple positions of each fiber bundle 45 at the proximal end of the fiber bundles 45. For example, in the embodiment shown in FIG. 6, the binding fibers 46 include three pairs of binding fibers 46*a*, 46*b*, 46*c* (total of six). Each pair of binding fibers is wound about different positions at the proximal end of each fiber bundle 45.

More specifically, the three pairs of binding fibers 46*a*, 46*b*, 46*c* are arranged at the proximal end of the bristle section 41 and extend parallel to each other in the longitudinal direction of the bristle section 41 to be sequentially adjacent in a direction in which the monofilaments 45*a* extend. In this case, the three pairs of binding fibers 46*a*, 46*b*, 46*c*, which are arranged to be sequentially adjacent, form walls that are adjacent to the clamping pieces 43*a* (see FIG. 5) of the clamping section 43.

The binding fibers 46 (46*a*, 46*b*, 46*c*) are formed of a fiber having high durability and flexibility. Such a fiber includes a rayon fiber, a cupro fiber, a polyester fiber, a polyamide fiber, an acrylic fiber, and a polypropylene fiber. The binding fibers 46 of the present embodiment are made of a polyester fiber.

Figure 7:
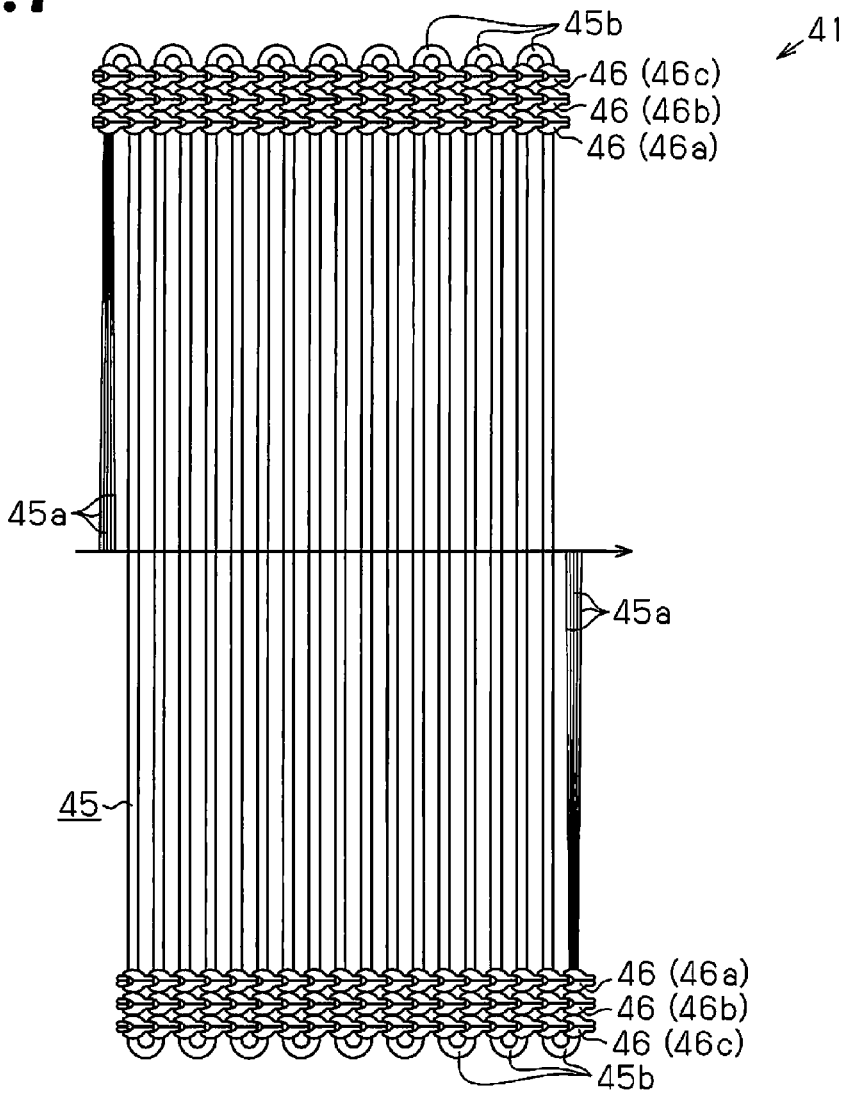
FIG. 7 is a partially enlarged schematic view showing the manufacturing process of the bristle section of FIG. 6.

FIG. 7 is a partially enlarged schematic view showing the manufacturing process of the bristle section 41. The long fiber bundle 45 is bent in a serpentine manner, and the binding fibers 46 (in this case, three pairs on each end (total of twelve)), which extend parallel to each other are wound at multiple positions inward of bent portions 45*b* on both ends. Then, the center of the fiber bundles 45 is cut (cut along the arrow in FIG. 7) so that two bristle sections 41 are simultaneously formed.

Using an application device (not shown), an adhesive synthetic resin material 47 is applied to the thus formed bristle section 41 in a certain width range from the position where the binding fiber 46*a* is wound to the bent portions 45*b*. In this manner, the monofilaments 45*a* are impregnated with the adhesive synthetic resin material 47 at a portion clamped by the pair of clamping pieces 43*a* (see FIG. 5).

Figure 8:
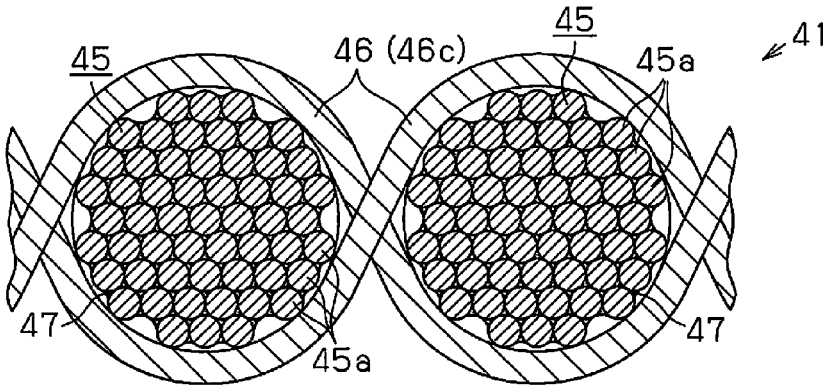
FIG. 8 is a cross-sectional view taken along line 8-8 of FIG. 6.

As shown in FIG. 8, the adhesive synthetic resin material 47 evenly permeates between the monofilaments 45*a* and solidifies so that the monofilaments 45*a* are fixed in a bundled state. As for the adhesive synthetic resin material 47 in the present embodiment, for example, a water-soluble synthetic resin material such as an acrylic resin emulsion, a urethane resin emulsion, and a vinyl acetate resin emulsion are preferable. The kind of the adhesive synthetic resin material 47 may be selected as required considering the compatibility with the material forming the monofilaments 45*a*.

When forming the brush 32, first, the proximal end of the bristle section 41 is inserted between the pair of clamping pieces 43*a* of the base 40 as shown in FIG. 5. Then, the binding fibers 46 of the bristle section 41 are clamped by the clamping pieces 43*a*. At this time, since the binding fibers 46 (46*a*, 46*b*, 46*c*) form the walls that are adjacent to the clamping pieces 43*a*, the binding fibers 46 contact the clamping pieces 43*a* in a stable manner.

In this state, the clamping pieces 43*a* are sewn to the binding fibers 46 and the proximal ends of the fiber bundles 45 with the sewing thread 44 using an industrial sewing machine (not shown). That is, the clamping pieces 43*a* (clamping section 43) are sewn (joined) to part of the bristle section 41 where the binding fibers 46 are arranged with the sewing thread 44. Thus, the brush 32 shown in FIG. 5 is obtained.

The operation of the rotary brush unit 22 will now be described.

As shown in FIG. 2, when the head 11 is placed on the floor surface F and the electric vacuum cleaner is operated, the motor 18 is driven, and the air inside the partition frame 15 passes through the air suction port 16 and then drawn by suction into the main body (not shown) of the electric vacuum cleaner via the connecting pipe 13.

At this time, being linked to the driving of the motor 18, the rotary brush unit 22 rotates counterclockwise as viewed from the left side (direction shown by the arrow in the drawing), and the bristle sections 41 (fiber bundles 45) of the rotary brush unit 22 are rubbed against the floor surface F. Then, dust on the floor surface F is swept by the bristle sections 41 and drawn by suction into the main body (not shown) of the electric vacuum cleaner with the air.

As described above, the binding fibers 46 of each bristle section 41 are in contact with the associated clamping pieces 43*a* in a stable manner, and the clamping pieces 43*a* are sewn to the binding fibers 46 and the proximal ends of the fiber bundles 45 with the sewing thread 44. That is, since each bristle section 41 is firmly joined to the associated base 40, each bristle section 41 is prevented from falling off the associated base 40 due to load applied to the brush 32 when sweeping dust on the floor surface F by the bristle section 41.

The present embodiment has the following advantages.

(1) The three pairs of the binding fibers 46*a*, 46*b*, 46*c* are sequentially adjacent in the direction in which the monofilaments 45*a* of the fiber bundles 45 extend, and form the walls. Since the walls are adjacent to the pair of clamping pieces 43*a* (clamping section 43) of the base 40, the base 40 is brought into contact with the bristle section 41 in a stable manner when sewing the base 40 to the bristle section 41. This allows the bristle section 41 to be sewn to the base 40 in a state in which the bristle section 41 is not easily raveled, and thus the bristle section 41 and the base 40 are firmly joined to each other. As a result, when the brushes 32 are rubbed against the floor surface F and load is applied to the brushes 32 during the use of the electric vacuum cleaner, each bristle section 41 is prevented from falling off the associated base 40.

(2) The pair of clamping pieces 43*a* (clamping section 43) of the base 40 is sewn to the part of the bristle section 41 where the three pairs of the binding fibers 46*a*, 46*b*, 46*c* are arranged. Thus, for example, even if the bristle section 41 is formed of material that is hard to be welded or material that is incompatible with the adhesive, the bristle section 41 and the base 40 are firmly and reliably joined together by sewing.

(3) The monofilaments 45*a* of the fiber bundles 45 are impregnated with the adhesive synthetic resin material 47. Due to adhesion of the synthetic resin material 47, the monofilaments 45*a* are firmly held in a bundled state as the fiber bundles 45. Thus, when the brushes 32 are rubbed against the floor surface F and load is applied to the brushes 32 during the use of the electric vacuum cleaner, the monofilaments 45*a* of the fiber bundles 45 are prevented from raveling, and the monofilaments 45*a* are prevented from falling off the fiber bundles 45.

(4) Only the parts of the fiber bundles 45 clamped by the clamping section 43, that is, the proximal end portions of the fiber bundles 45 are impregnated with the synthetic resin material 47. The distal end portions of the fiber bundles 45 that are not clamped by the clamping section 43 are not impregnated with the synthetic resin material 47. Thus, the distal end portions of the fiber bundles 45 are prevented from becoming hard due to the synthetic resin material 47. This reliably maintains the performance of the brushes 32, and thus reliably maintains the performance of the rotary brush unit 22.

Modified Embodiment

The above described embodiment may be modified as follows.

Each brush 32 may be impregnated with the synthetic resin material 47 in a certain range to a point between the distal end and the position where the binding fiber 46*a* is wound. In this case, the synthetic resin material 47 is preferably prevented from reaching the distal end portions of the fiber bundles 45.

In each brush 32, the monofilaments 45*a* of the fiber bundles 45 do not necessarily have to be impregnated with the synthetic resin material 47.

In each brush 32, the bristle section 41 and the base 40 do not necessarily have to be joined by sewing, but may be joined by, for example, welding or adhesion using an adhesive. The three pairs of the binding fibers 46*a*, 46*b*, 46*c* of the bristle section 41 form the walls that will be adjacent to the pair of clamping pieces 43*a* of the base 40. Thus, even in the case in which the monofilaments 45*a* of the bristle section 41 are formed of, for example, material that is hard to be welded or material that is incompatible with an adhesive such as a fluorine fiber and a carbon fiber, the bristle section 41 and the base 40 can be joined by welding or adhesion as long as the compatibility of the material forming the base 40 and the material forming the three pairs of the binding fibers 46*a*, 46*b*, 46*c* is ensured.

In each brush 32, the number of the binding fibers 46 wound around the fiber bundles 45 is not limited to the number described in the above-mentioned embodiment, but may be any number.

In each brush 32, the base 40 may be sewn to the bristle section 41 with more than one sewing thread 44.

The brushes 32 may be used to clean a filter of air-conditioners or fans or to scrape toner adhered to a photoconductive drum in image forming apparatuses. In this case, the brushes 32 do not necessarily have to be rotated during use, but may be linearly moved while being pressed against an object.

Therefore, the present examples and embodiments are to be considered as illustrative and not restrictive and the invention is not to be limited to the details given herein, but may be modified within the scope and equivalence of the appended claims.

The invention claimed is:

1. A brush comprising:

a bristle section, which includes a plurality of fiber bundles and a plurality of binding fibers, which bind and couple the fiber bundles together; and a base, which has a clamping part for clamping a proximal end of the bristle section, wherein the fiber bundles are arranged in a row in a direction perpendicular to a direction in which fibers of the fiber bundles extend, the fiber bundles have bent portions at the proximal end of the bristle section, the binding fibers are sequentially adjacent in a direction in which the fibers of the fiber bundles extend, the clamping part clamps the proximal end of the bristle section to cover the binding fibers, and adjacent ones of the binding fibers are in contact with each other between the clamping part and the fiber bundles.

2. The brush according to claim 1, wherein the clamping part is sewn to part of the bristle section where the binding fibers are arranged.

3. The brush according to claim 1, wherein the fiber bundles are impregnated with an adhesive synthetic resin material.

4. The brush according to claim 3, wherein part of the fiber bundles clamped by the clamping part is impregnated with the synthetic resin material.

5. The brush according to claim 1, wherein the brush is included in a rotary brush unit for an electric vacuum cleaner, the rotary brush unit comprises a rotating body configured to be rotationally accommodated in a head for drawing in dust on a floor surface, the brush is attached to the rotating body such that the brush is rotated when the head is moved on the floor surface, and the brush contacts the floor surface at the same time that the rotating body is rotated.

* * * * *